US005704488A

United States Patent [19]

Smith

[11] Patent Number: 5,704,488

[45] Date of Patent: Jan. 6, 1998

[54] CONCEALABLE PALLET FOR SHIPPING/ DISPLAY CONTAINER

[75] Inventor: Michael J. Smith, Orangeburg, N.Y.

[73] Assignee: Arrow Art Finishers, Inc., Bronx, N.Y.

[21] Appl. No.: 670,446

[22] Filed: Jun. 26, 1996

[51] Int. Cl.[6] ..... B65D 19/00

[52] U.S. Cl. ..... 206/598; 206/596; 206/386; 108/51.1

[58] Field of Search ..... 206/386, 596, 206/598, 600; 108/51.1, 51.3, 56.1, 56.3

[56] References Cited

U.S. PATENT DOCUMENTS

| | | | |
|---|---|---|---|
| 2,894,671 | 7/1959 | Nicholls | 206/386 |
| 3,776,145 | 12/1973 | Anderson et al. . | |
| 5,291,837 | 3/1994 | Adams, Jr. . | |
| 5,353,936 | 10/1994 | Dockstader et al. | 206/386 |
| 5,383,408 | 1/1995 | Searcy . | |

FOREIGN PATENT DOCUMENTS

| | | | |
|---|---|---|---|
| 2121003 | 12/1983 | United Kingdom | 206/386 |

*Primary Examiner*—David T. Fidei
*Attorney, Agent, or Firm*—Kirschstein, et al.

[57] ABSTRACT

A container arrangement for accommodating goods both while the same are being stored and shipped and while they are being displayed at the final destination includes a container including at least one compartment for holding such goods, a pallet of substantially the same contour as the container when viewed from above in a use orientation of the arrangement and situated underneath the container to support the same at an elevation above ground, and a skirt mounted at the interface between the container and the pallet and covering the pallet to conceal it from view at least while the arrangement is being used for displaying the goods. A plastically deformable element embedded in the skirt holds a movable skirt portion in the concealing position.

21 Claims, 2 Drawing Sheets

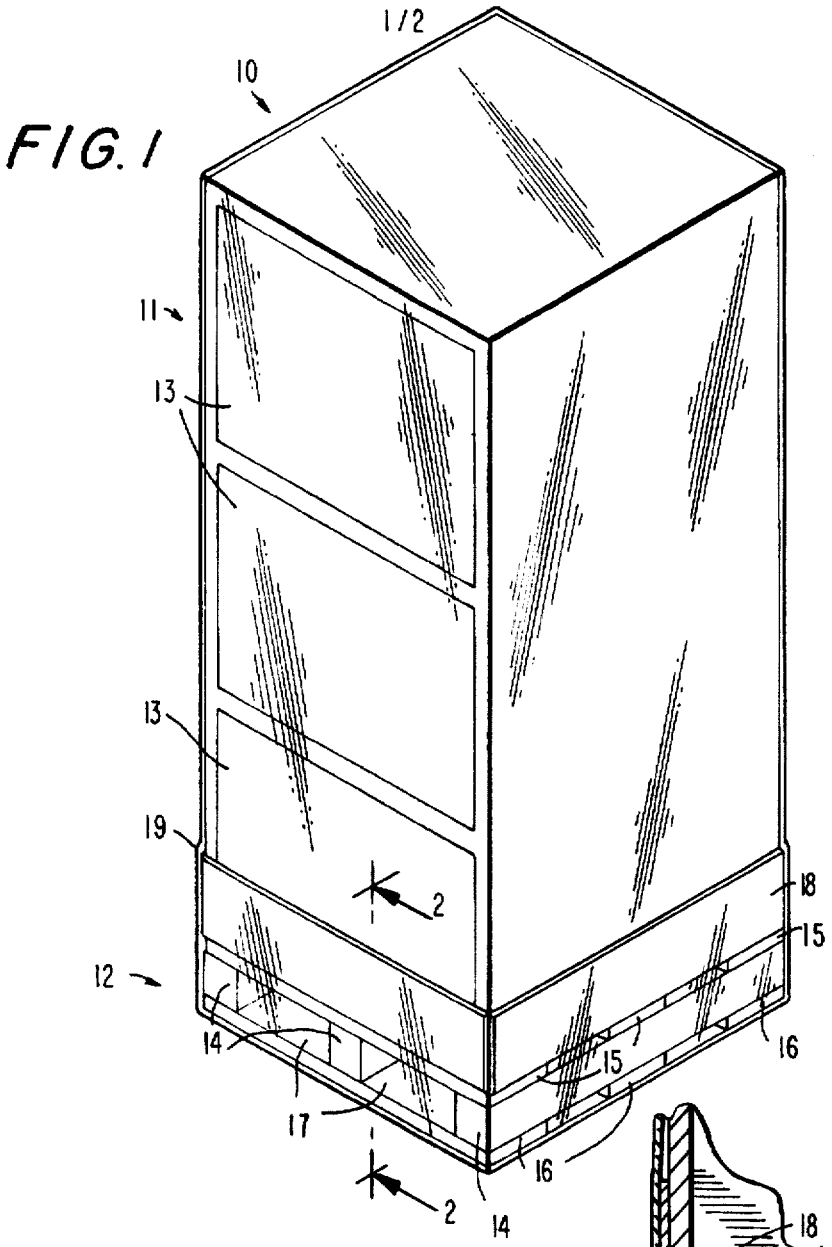
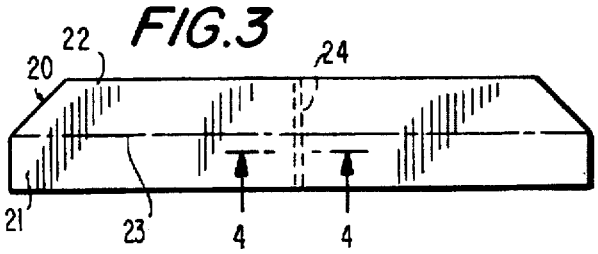
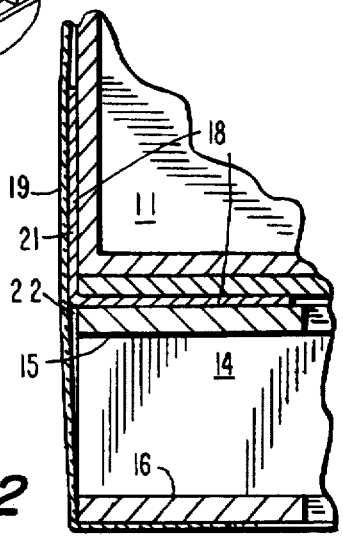
FIG.2

FIG.4
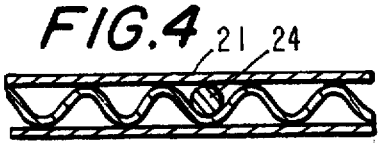
FIG.5
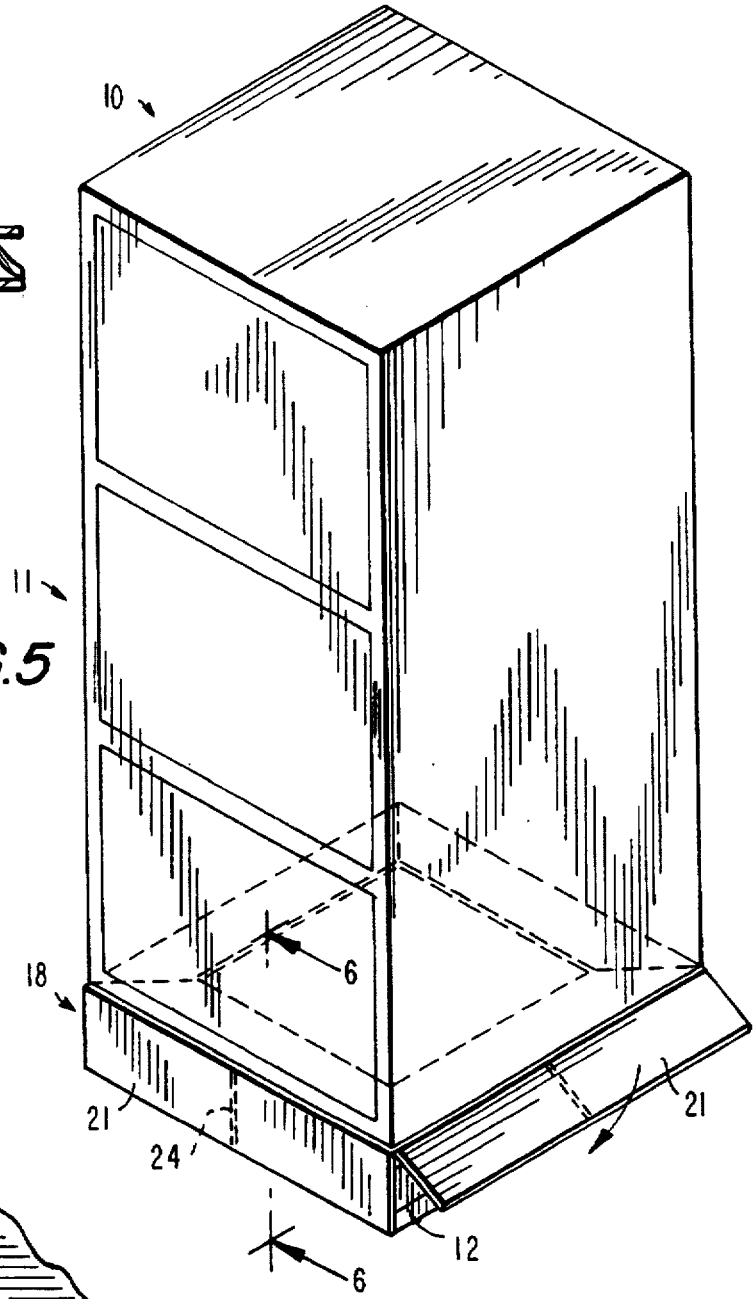
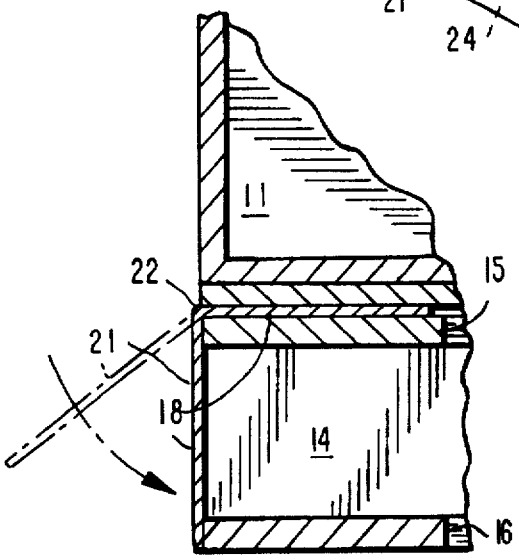
FIG. 6

CONCEALABLE PALLET FOR SHIPPING/ DISPLAY CONTAINER

BACKGROUND OF THE INVENTION

1. Field of the Invention

The present invention relates to containers for goods in general, and more particularly to containers holding such goods when on display in a retail establishment, but preferably also prior to that while in storage and in transit.

2. Description of the Related Art

There are already known various constructions of containers for goods, among them such that are being used both for storing and shipping goods and holding such goods when on display in a retail store. While it has been a widespread practice for many decades, if not centuries, in the retail industry, for instance in grocery stores, to use the containers (such as sacks, crates, cardboard boxes) that the various goods (e.g., coffee beans, fruits, soft drink bottles) came in to hold such goods for display to potential purchasers, the specific design of shipping containers in such a way that they would be suited for displaying the goods shipped in them in an attractive or even aesthetically pleasing manner is of a relatively recent vintage.

This notwithstanding, such relatively sightly appearance not only is gaining in acceptance, but also has become more and more popular with retailers, especially because in many instances it significantly reduces the amount of effort involved in, and hence the cost of, putting such goods on display. This is so because such goods no longer need to be taken out of shipping boxes or crates and put on shelves or the like, without suffering an attractiveness penalty; as a matter of fact, with proper design of the container, the goods may be more attractive when presented in such containers than when languishing on ordinary shelves or racks.

Because of the growing demand for such attractive shipping containers, they are being increasingly used for goods of a variety of kinds and sizes. In fact, there is even a trend, fueled by the desires of both the shippers who prefer sending goods in bulk and the retailers who do not like having the aisles or other areas of their stores cluttered with a multitude of containers, no matter how attractive they are, toward increasing the size of such containers. Of course, with increasing size comes increasing weight, and that, except in rare instances when the goods are of low density or specific weight, causes problems in handling the containers in storage, in transit and at the final destination. To deal with such problems, it is currently customary, in view of the substantial weight of such shipping containers, to use mechanical lifting means, such as forklift trucks, for transporting them from one location to another, such as from a storage facility to a delivery truck, etc. No matter what the particular construction of such a lifting device, it ordinarily has to engage the container from below, that is, its prongs or similar components have to penetrate to a considerable distance under the bottom surface of the container before they can act in the upward direction to lift the container. This task is greatly facilitated by the frequently used expedient of placing the respective container on a supporting structure, be it called a pallet or by a different name, constructed to hold the container at a relatively small and yet significant distance above the floor, and provided in one way or another with substantially horizontally extending passages or channels dimensioned and oriented for easy penetration of the aforementioned prongs into them.

Even this approach is not faultless, however. More particularly, experience has shown that taking the completely or partially filled container off of the supporting structure is not an easy task, if not for any other reason than because of the significant weight of the container. On the other hand, it is often felt that, if the container were left on the pallet while being used in the store for displaying the goods, so to speak, "in the best light", the often battered, factory- or warehouse-like looks of the pallet would significantly detract from the otherwise pleasing countenance of the container and thus reduce the aesthetic appeal of the overall arrangement.

OBJECTS OF THE INVENTION

Accordingly, it is a general object of the present invention to avoid the disadvantages of the prior art.

More particularly, it is an object of the present invention to provide a shipping/display container arrangement for goods that does not possess the drawbacks of the known arrangements of this type.

Still another object of the present invention is to devise a container arrangement of the type here under consideration that possesses the advantages of conventional container/pallet combinations without suffering the unsightliness penalty.

It is yet another object of the present invention to design the above container arrangement in such a manner as to embody both the container and the support/lifting functions in a relatively attractive package.

A still further object of the present invention is to develop a container arrangement of the above type in which the pallet is easily and reliably hidden from view at the final destination.

A concomitant object of the present invention is so to construct the container arrangement of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a shipping/display container arrangement which includes a container proper. This container includes at least one compartment for receiving goods while being stored, shipped to a final destination, and displayed there and has a predetermined horizontal cross section as considered in a use orientation of the arrangement. The arrangement further includes a pallet having a horizontal cross section bounded by respective circumferential surfaces that substantially corresponds to that of the container. This pallet is situated underneath the container in the use orientation and preferably has at least two channels for temporarily receiving the prongs of a lifting device as the arrangement is in the process of being transported from one location to another.

In accordance with the present invention, the arrangement further includes at least one skirt having a mounting region interposed between the container and the pallet, and a skirt region connected to and extending downwardly from the mounting portion and covering the circumferential surfaces of the pallet at least while the container is being used in the use orientation for displaying the goods. A particular advantage of the arrangement as described so far is that the container need not be taken off of the pallet when it reaches its final destination and is to be used thereat for displaying the goods; rather, the entire arrangement is given an aesthetically pleasing appearance by the presence of the skirt that covers the pallet in the display condition of the arrangement and thus hides it from view.

Advantageously, the skirt region consists of a plurality of separate skirt portions individually secured to the mounting region and each covering a different one of the circumferential surfaces in a concealment position thereof. This feature has an especially advantageous application when, in accordance with the present invention, at least that one of the separate skirt portions that extends across one end of each of the channels in its concealment position is mounted on the mounting region for pivoting about a substantially horizontal axis situated at the interface between the container and the pallet out of the concealment position and into an access position in which it permits access to the one end of each of the channels. In this context, it is especially advantageous when the one skirt portion is substantially juxtaposed with the container in its access position.

According to an advantageous facet of the present invention, there is further provided at least one bendable element secured to and extending across the pivoting axis between the one skirt portion and the mounting region. Such a bendable element is of a material that undergoes plastic deformation during the movement of the one skirt portion between the concealment and access positions thereof and retains the one skirt portion in the newly acquired one of its positions. Advantageously, the bendable element is embedded in the one skirt portion and the mounting region, especially by being inserted into a corrugation of corrugated board material of which the skirt is constituted.

According to another aspect of the present invention, the mounting region includes a plurality of discrete mounting portions each separately connected with a different one of the skirt portions. Last but not least, it is advantageous for the container arrangement to further include an outer envelope or film encasing the container, the skirt element and the pallet in their assembled condition prior to their use for displaying goods.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a perspective view of a shipping and display container arrangement of the present invention in its as-manufactured state;

FIG. 2 is a broken-away sectional view on a somewhat enlarged scale, taken on line 2—2 of FIG. 1;

FIG. 3 is a top plan view of a constituent component of a cardboard skirt of the present invention for use in the arrangement depicted in FIG. 1;

FIG. 4 is a sectional view on a taken on line 4—4 of FIG. 3, on a scale enlarged to about the actual size;

FIG. 5 is a view similar to that of FIG. 1 but showing the container arrangement just prior to assuming its as-used state; and FIG. 6 is a view corresponding to that of FIG. 2 but taken on line 6—6 through the container arrangement in its as-used state.

DETAILED DESCRIPTION OF THE PREFERRED EMBODIMENT

Referring now to the drawing in detail, and first to FIG. 1 thereof, it may be seen that the reference numeral 10 has been used therein to identify a container assembly embodying the present invention, in its entirety. The container arrangement 10 of the present invention includes as some of its constituent components a container proper designated by the reference numeral 11, and a supporting structure 12 shown to be in the form of a pallet or skid.

The container 10 may have any shape and form, but for the sake of convenience and ease of understanding is shown to have the traditional rectangular box or parallelepiped configuration. As may also be observed in FIG. 1, the interior of the container 11 may be subdivided into a plurality of (as shown, three) separate compartments 13. Each of these compartments 13 is suitable for containing one or more of the items, articles or substances (generally referred to as goods) to be displayed in the retail establishment in the container arrangement 10 after the latter has been delivered there and placed at any suitable location.

For the sake of argument, it has been assumed above that the compartments 13 are open at their ends to which the respective lead lines point. However, it is also possible and contemplated within the context of the present invention for the container arrangement 10 to include respective attached or separate lids (not specifically shown) that can be used to close the compartments 13 even at these ends at least while the container arrangement 10 is in its original state in which it is being used for storing and shipping the goods. Such lids, if provided in the first instance, could be secured to the rest of the container 11 while in its original state, in order to safely hold the goods in the respective compartments 13. Yet, even in this instance, the lids would be easily detachable from the rest of the container 11 in order to provide the desired unobstructed visual and other access to the individual compartments 13 when the container 11 is being used in its display state at the final destination for displaying such goods.

As shown in FIG. 1 of the drawing, the container 11 rests on top of the pallet 12. While it is conceivable for the pallet 12 to have an outline, that is width and depth dimensions, smaller or larger than the container 11, and in some instances it may be even desired, it is currently preferred for the outline of both of them to be substantially the same, meaning that neither one of them will significantly project beyond the other either in the original shipping state or in the ultimate display state of the container arrangement 10. In all significant respects, the pallet 12 does not differ from those that are currently being widely used in factories, storage facilities and even stores, usually as temporary supports for a variety or items or structures.

Thus, the pallet 12 is constructed to be reminiscent of a lattice, that is, it includes a floor support comprised of main beams 14, a raised platform comprised of upper crossties 15, and lower crossties 16. The crossties 15 and 16 extend substantially at right angles to the main beams 14 and are secured to them by nails, staples, screws or similar fastening elements. The main beams 14 are substantially parallel to one another and spaced from each other by a predetermined distance in each instance, thus forming respective channels 17. The channels 17 are sized and spaced, as is customary, in such a manner as to permit the lifting prongs of a forklift truck or a similar lifting device to be easily introduced into them and to subsequently engage the upper crossties 15 from underneath and to lift such crossties 15 and with them also the remainder of the container arrangement 10.

To present a complete picture, it is to be mentioned that the container arrangement 10 further includes a skirt component 18 that is located at a region of the interface of the container 11 proper and the pallet 12, and an outer envelope or wrap 19 that may, but need not be, transparent as indicated in FIG. 1 by the visibility of the various features of the container 11, the pallet 12, and the skirt component 18 through it, and the presence of which is denoted, due to the relative thinness of the wrapping material, merely by doubling of the outline of the arrangement 10, and by appropriate shading. The purpose of the wrap 19 will be explained later; at this juncture, however, attention will be directed at the construction, shape, positioning and function of the skirt 18.

As a comparison of FIGS. 2 and 3 of the drawing will reveal, the skirt component or simply skirt 18 is not only situated at, but also penetrates into, the interface between the container 12 proper and the pallet 12. FIG. 3 of the drawing depicts a section 20 of the skirt 18, which may be separate from the rest of the skirt 18 as shown, or integral with adjacent sections of the skirt 18 that are similar or identical to the illustrated section 20 and extend substantially at right angles thereto. In either event, the section 20 includes a skirt portion 21 of a basically rectangular contour and a generally trapezoidal mounting portion 22 that is joined to the skirt portion 21 by a flexible hinge or crease region 23.

As shown in FIG. 2, the mounting portion 22 is received between the bottom surface of the container 12 and the top surface of the pallet 12 (i.e., the upper surfaces of the respective upper crossties 15). In some instances, the confinement of the mounting portion 22 between such surfaces, coupled with the not insubstantial weight of the container 12 and its contents, is sufficient to assure retention of the skirt 18 (or of each and every one of the sections 20 thereof if separate from each other) in position once the filled container 11 has been lowered onto the pallet 12. However, it is currently preferred to secure the mounting portion 22 of the respective skirt section 20 (or a corresponding portion of the unitary skirt component 18) to one of the container 11 and the pallet 12, especially to the latter, so as to assure that the skirt 18 (and/or its discrete sections 20) stay in place even during the assembly of the container 11 with the pallet 12.

In FIGS. 1 and 2 of the drawing, the skirt portion 21 is shown to assume its upturned position in which it and its kin embrace or substantially completely surround the bottom region of the container 12 proper. While this position is not of too much importance (except for the sake of consistency) as far as many if not most of the skirt sections 20 are concerned, it is critical at least for that one which is illustrated at the left in FIG. 1 (and also in FIG. 2) and/or its opposite counterpart, in that it (or they) would otherwise cover up the respective free ends of the passages 17 and thus bar the entry of the aforementioned forklift truck prongs into the passages 17. If, on the other hand, the respective skirt portion 21 is upturned, then the only thing standing in the way of penetration of the prongs into the passages 17 is the wrap 19.

Now, the wrap is, as mentioned before, a relatively thin plastic film and, consequently, relatively weak, which means that it does not offer too much resistance to the advancing prongs and is rather easily pierced thereby. Yet, this piercing does not compromise the structural integrity of the wrap 19 outside the immediate vicinity of the punched-through holes, so that the wrap 19 still continues to perform its intended function of holding the assembly or arrangement 10 together, until it is removed in its entirety at the final destination. Obviously, the complete removal of the wrap 19 also gets rid of its damaged (and unsightly) portion so that it does not detract from the appearance of the arrangement 10.

As a comparison of FIGS. 3 and 4 of the drawing will reveal, the skirt portion 21 may be made, like the rest of the section 20, of corrugated cardboard or a similar material. The use of this material, besides other well known advantages thereof, also makes it relatively easy to embed an elongated reinforcing element 24 therein by sliding the element 24 into one of the corrugations or flutes of the corrugated board. The reinforcing element 24 is embedded both in the mounting portion 22 and in the skirt portion 21 of the section 20, extending through the crease 23. Although not preferred, the reinforcing element 24 could be taped or otherwise attached on the interior surface of each skirt portion, so long as the element extends over the crease 23. The element 24 is made of a material (typically a metallic rod) that can be deformed after overcoming a certain level of resistance but thereafter substantially retains the newly acquired shape, so that a similar level of resistance is encountered when attempting to return the element 24 to its original configuration. This property of such a material is being taken advantage of in the arrangement 10 of the present invention in that the reinforcing element 24 is initially used for holding the respective skirt portion 22 in its upwardly turned position.

However, as shown in FIGS. 5 and 6 of the drawing, after the arrival of the arrangement 10 at the final destination, its placement at the desired location, and removal of the aforementioned wrap 19, the skirt portions 21 are moved as indicated by respective arrows into their final or use positions in which they extend substantially vertically downwardly from the above-mentioned interface between the container 11 and the pallet 12. This movement entails deformation of the respective embedded elongated reinforcing elements 24 so that, after the downward flipping of the skirt portions 21 is completed, the reinforcing elements 24 will hold and maintain them in such downwardly turned positions.

It should be clearly apparent from the drawing that in these positions the skirt portions 21, which have relatively pleasing appearances, will cover up the relatively unattractive pallet 12 and hence hide it from view. The reinforcing elements are strong enough to prevent the "corners" of the skirt from opening up. In other words, the gaps between adjacent skirt sections at the comers of the pallet are maintained as small as possible, and need not be taped shut. As a matter of fact, if the skirt sections 20 are made identical or similar in appearance to the container 11 (e.g., by being made of the same or similar material), then the transition or interface between the container 11 and the skirt 18 will be hardly noticeable to a casual observer, thereby making for an attractive display that can be used at a point-of-sale site without having to remove the container from the pallet.

It will be understood that each of the elements described above, or two or more together, may also find a useful application in other types of constructions differing from the type described above.

While the present invention has been described and illustrated herein as embodied in a specific construction of a shipping/display container arrangement for goods, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A shipping/display container arrangement, comprising:

a) a container for shipping and displaying goods;

b) a pallet for supporting said container from below said container, said pallet having exterior peripheral surfaces; and c) a skirt having a mounting region secured to said pallet, and a skirt region mounted on said mounting region for movement between a raised access position in which said skirt region is remote from said peripheral surfaces, and a lowered concealment position in which said skirt region covers and conceals said peripheral surfaces.

2. The container arrangement as defined in claim 1, wherein said container and said pallet have peripheries of the same size.

3. The container arrangement as defined in claim 1, wherein said pallet has a raised platform, a floor support for supporting said raised platform above the ground, and elongated channels having opposite ends which are exposed in said access position, and which are hidden in said concealment position.

4. The container arrangement as defined in claim 1, wherein said skirt region includes a plurality of skirt portions, one for each of said peripheral surfaces of said pallet, each skirt portion being individually movable between said positions.

5. The container arrangement as defined in claim 4, wherein each skirt portion is movable through an are of about 180° between said positions.

6. The container arrangement as defined in claim 4, wherein each skirt portion is generally planar and lies in a generally upright vertical plane in both said positions.

7. The container arrangement as defined in claim 4, wherein each skirt portion is pivotable about a generally horizontal crease line located between said mounting region and each skirt portion.

8. The container arrangement as defined in claim 4, wherein said mounting region includes a plurality of mounting portions, one for each skirt portion, each mounting portion being individually connected to said pallet.

9. The container arrangement as defined in claim 1; and further comprising means for selectively maintaining said skirt region in said access position, and for maintaining said skirt region in said concealment position.

10. The container arrangement as defined in claim 9, wherein said skirt region includes a plurality of skirt portions; and wherein said mounting region includes a plurality of mounting portions; and wherein each skirt portion is mounted on a respective mounting portion for pivoting movement about a respective pivot axis between said positions; and wherein said maintaining means includes a plurality of shape-retaining, bendable elements each secured to, and extending across, said respective pivot axis between the respective skirt and mounting portions.

11. The container arrangement as defined in claim 10, wherein said skirt and mounting regions have internal passages in which the bendable elements are slidably inserted and frictionally held.

12. A shipping/display container arrangement comprising:

a) a container including at least one compartment for receiving goods while being stored, shipped to a final destination, and displayed there, said container having a predetermined horizontal cross section as considered in a use orientation of the arrangement;

b) a pallet having a horizontal cross section bounded by respective circumferential surfaces that substantially corresponds to that of said container, situated underneath the latter in said use orientation, and having at least one channel for temporarily receiving the prongs of a lifting device as the arrangement is in the process of being transported from one location to another; and c) at least one skirt having a mounting region interposed between said container and said pallet, and a skirt region connected to and extending downwardly from said mounting portion and covering said circumferential surfaces of said pallet at least while said container is being used in said use orientation for displaying the goods.

13. The container arrangement as defined in claim 12, wherein said skirt region consists of a plurality of separate skirt portions individually secured to said mounting region and each covering a different one of said circumferential surfaces in a concealment position thereof.

14. The container arrangement as defined in claim 13, wherein at least that one of said separate skirt portions that extends across one end of said channel in said concealment position thereof is mounted on said mounting region for pivoting about a substantially horizontal axis situated at the interface between said container and said pallet out of said concealment position and into an access position in which it permits access to said one end of said channel.

15. The container arrangement as defined in claim 14, wherein said one skirt portion is substantially juxtaposed with said container in said access position thereof.

16. The container arrangement as defined in claim 14, and further comprising at least one bendable element secured to and extending across said pivoting axis between said one skirt portion and said mounting region, said bendable element being of a material that undergoes a plastic deformation during the movement of said one skirt portion between said concealment and access positions thereof and retains said one skirt portion in the newly acquired one of said positions thereof.

17. The container arrangement as defined in claim 16, wherein said bendable element is embedded in said one skirt portion and said mounting region.

18. The container arrangement as defined in claim 17, wherein said skirt is constituted of a corrugated board material having internal corrugations, and wherein said bendable element is slidably inserted into one of said corrugations.

19. The container arrangement as defined in claim 12, and further comprising an outer envelope encasing said container, said skirt and said pallet in their assembled condition.

20. A concealable pallet, comprising:

a) a raised platform for supporting a container;

b) a floor support for supporting said raised platform above the ground, said support and said platform having exterior peripheral surfaces; and c) a skirt having a mounting region secured to said platform, and a skirt region mounted on said mounting region for movement between a raised access position in which said skirt region extends above said raised platform and is remote from said peripheral surfaces, and a lowered concealment position in which said skirt region extends below said raised platform and covers and conceals said peripheral surfaces.

21. The pallet as defined in claim 20, and further comprising a bendable element secured to and extending between said mounting region and said skirt region, said bendable element being of a material that undergoes a plastic deformation during movement between said access and concealment positions and retains said skirt region in a selected one of said positions.

* * * * *